US005193496A

United States Patent [19]

Krüger

[11] Patent Number: 5,193,496

[45] Date of Patent: Mar. 16, 1993

[54] VARIABLE ACTION ARRANGEMENT FOR A LIFT VALVE

[75] Inventor: Hermann Krüger, Wolfsburg, Fed. Rep. of Germany

[73] Assignee: Volkswagen AG, Fed. Rep. of Germany

[21] Appl. No.: 825,526

[22] Filed: Jan. 24, 1992

[30] Foreign Application Priority Data

Feb. 12, 1991 [DE] Fed. Rep. of Germany ..... 4104140

[51] Int. Cl.[5] ..... F01L 1/12; F01L 1/24

[52] U.S. Cl. ..... 123/90.16; 123/90.48

[58] Field of Search ..... 123/90.15, 90.16, 90.17, 123/90.48, 90.49, 90.55

[56] References Cited

U.S. PATENT DOCUMENTS 4,905,639 3/1990 Konno ..... 123/90.16
5,036,807 8/1991 Kaneko ..... 123/90.16
5,090,364 2/1992 McCarroll et al. ..... 123/90.16

FOREIGN PATENT DOCUMENTS 3532549 3/1987 Fed. Rep. of Germany .
3738556 7/1988 Fed. Rep. of Germany .
3815668 11/1989 Fed. Rep. of Germany .

*Primary Examiner*—E. Rollins Cross
*Assistant Examiner*—Weilun Lo
*Attorney, Agent, or Firm*—Brumbaugh, Graves, Donohue & Raymond

[57] ABSTRACT

A force-transmitting arrangement to effect opening of a lift valve includes a central plunger responsive to the action of a main cam and a valve-engaging piston enclosing a pressure chamber. In addition, another pressure chamber surrounding the plunger and within a displaceable cup plunger communicates with a pressure medium line having a control valve. The cup plunger is responsive to an additional cam having a different lift curve from the main cam. When the control valve is closed, the lift curve of the additional cam is transmitted to the lift valve by way of both pressure chambers. When the control valve is open, the lift curve of the main cam is transmitted to the lift valve.

13 Claims, 3 Drawing Sheets

VARIABLE ACTION ARRANGEMENT FOR A LIFT VALVE

BACKGROUND OF THE INVENTION

This invention relates to variable valve action arrangements for lift valves operated by a cam in which a hydraulic chamber is interposed between the valve and the cam.

As disclosed in German Offenlegungsschrifts Nos. 35 32 549 and 38 15 668, variable action lift valves are advantageous because they permit variation, and therefore optimization, of the valve action timing of a machine equipped with the valve, such as a motor vehicle internal combustion engine, as a function of the machine operating parameters even during operation of the machine. In the preferred application of the invention, which is the action for an intake or exhaust valve of an internal combustion engine, variable valve control times and variable valve strokes can be used to influence various engine operating parameters such as: the torque curve by cylinder charge control; crude exhaust emissions, for example, by controlled internal exhaust return; fuel consumption by controlling combustion by way of residual gas content or by decreasing the work required for gas exchange; and brake performance by valve shut-off as described, for example, in German Offenlegungsschrift No. 37 38 556.

In the operation of conventional variable valve action arrangements of this kind, the control valve acts directly on the pressure of a liquid between a plunger and a piston in a hydraulic chamber located between the lift valve and the operating cam. These arrangements provide two extreme positions of the control valve. In one position, the pressure chamber, being closed, constitutes a rigid transmission link. In the other position, the pressure chamber is open to a low-pressure portion of the hydraulic system so that no force can be transmitted by the pressure chamber. With such arrangements, it must be possible to establish predetermined valve lift curves which are reproducible with high precision over considerable lengths of time in operation. Considering, for example, the preferred application, i.e., to control operation of an intake or exhaust valve of an internal combustion engine, maintaining exact preassigned times of valve opening and closing is vital to produce the desired operation of the engine. In this connection, the provision of a valve clearance compensating arrangement is important because it will ensure independence of the lift curve of the valve from wear of the engaging portions of the valve member and the valve seat.

SUMMARY OF THE INVENTION

Accordingly, it is an object of the present invention to provide a variable action arrangement for a lift valve which overcomes the disadvantages of the prior art.

Another object of the invention is to provide a variable action arrangement permitting generation of a valve lift curve which is accurately defined by cams and which permits valve clearance compensation by a simple and compact structure while retaining the advantages of conventional variable valve actions.

These and other objects of the invention are attained by providing a variable action valve arrangement for a lift valve which includes a main cam acting on the lift valve through a hydraulic force-transmitting arrangement having a pressure chamber and an additional cam acting on another pressure chamber to control the spacing provided by the hydraulic force-transmitting arrangement between the main cam and the valve.

Thus, contrary to the above-mentioned prior art, the variable valve action according to the invention varies the effective length of the hydraulic force-transmission arrangement without producing a corresponding variation of the pressure in the pressure chamber since an additional pressure chamber is provided. Consequently, the main pressure chamber may be utilized to accommodate a hydraulic valve-clearance compensating arrangement. Moreover, at least two synchronously operated cams are included. The main cam acts on the plunger in a conventional manner, either directly or through a linkage, and through the pressure chamber and the piston on the lift valve side, on the stem of the lift valve. At the same time, another cam applies force to the base of a displaceable cup plunger surrounding the valve stem, which encloses the variable-length pressure chamber. One advantage of the invention is that the plunger with its associated cam can be operative even with a low engine oil supply because the pressure of the pressure medium in the pressure chamber is not affected by changes outside the pressure chamber. In this case as well as in that in which there is a corresponding reduction of the pressure in the pressure chamber, the lift curve of the valve is identical with that of the cam acting upon the plunger. On the other hand, where there is a corresponding elevation of the pressure in the pressure chamber, the additional cam, which is normally designed to provide a longer lift than that of the main cam, lifts the force-transmitting arrangement, including the plunger, away from the main cam.

Depending on the design of the additional cam, the opening time of the lift valve may be advanced with or without increasing the lift, the closing of the lift valve may be postponed with or without lengthening of lift, and the time of valve opening can be advanced and that of closing retarded, again with or without increasing the lift.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
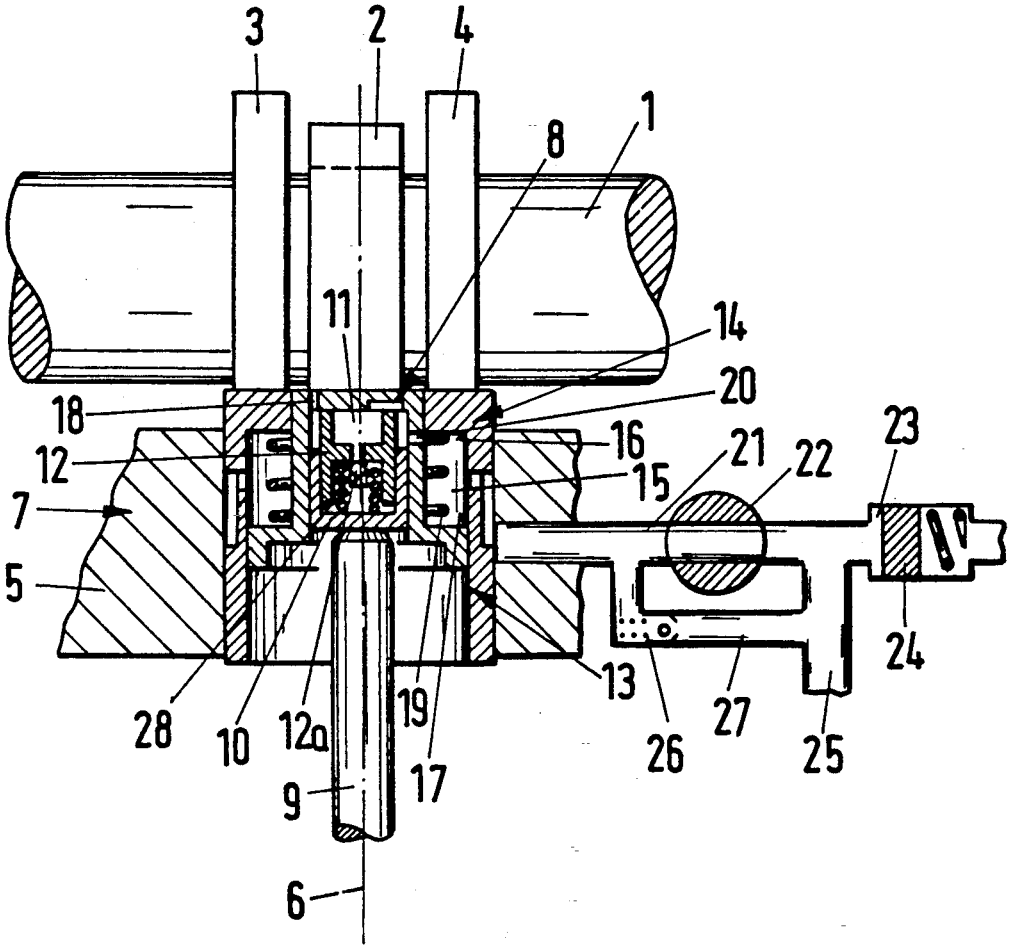
FIG. 1 is a schematic fragmentary view, partly in section, illustrating a representative embodiment of a variable action valve arrangement according to the invention for use in a reciprocating-piston internal combustion engine.

Referring first to the typical embodiment shown in FIG. 1, a camshaft 1, driven in the conventional manner by an internal combustion engine, carries a valve lift cam 2 and two further cams 3 and 4 mounted on opposite sides of the cam 2. In this embodiment, the additional cams 3 and 4 have identical configurations but have a valve lift curve which differs from the lift curve of the cam 2.

A force-transmitting arrangement 7, which is supported for sliding motion in the direction of the centerline 6 of an opening in a cylinder head 5, includes a plunger 8 having a contact surface for engagement by the cam 2 and a valve-engaging piston 10 which is slidably mounted in the plunger 8 has a closed end engaging a valve stem 9. The valve stem 9 is urged by a conventional valve-return compression spring, not shown, toward the valve closing position, i.e., upward in FIG. 1, so that the valve stem 9 always engages the end of the piston 10. Between the piston 10 and the head of the plunger 8, there is a pressure chamber 11 which contains a device 12, which has a conventional structure and therefore will not be described in detail, for compensating valve clearance. The device 12 includes, as an important component, a check valve 12*a* which assures that the pressure chamber 11 can take in additional pressure medium as required during the non-lifting phase of the cam 2, i.e., with the valve 9 closed.

The two additional cams 3 and 4, which are mounted on opposite sides of the cam 2, engage an annular head 14 of a cup plunger 13 which receives the plunger 8 in an internal cavity. The two plungers 8 and 13 are shaped so that they define an annular pressure chamber 15 between them. The pressure chamber 15 is bounded in the axial direction by the inner surface 16 of the head 14 of the cup plunger 13 and by a shoulder 17 formed in the plunger 8, and a compression spring 19 extends between these two surfaces. A throttle 20 provides flow communication between the pressure chamber 11 and the pressure chamber 15, permitting the valve-clearance compensating device 12 to act on the plunger 8.

Figure 2:
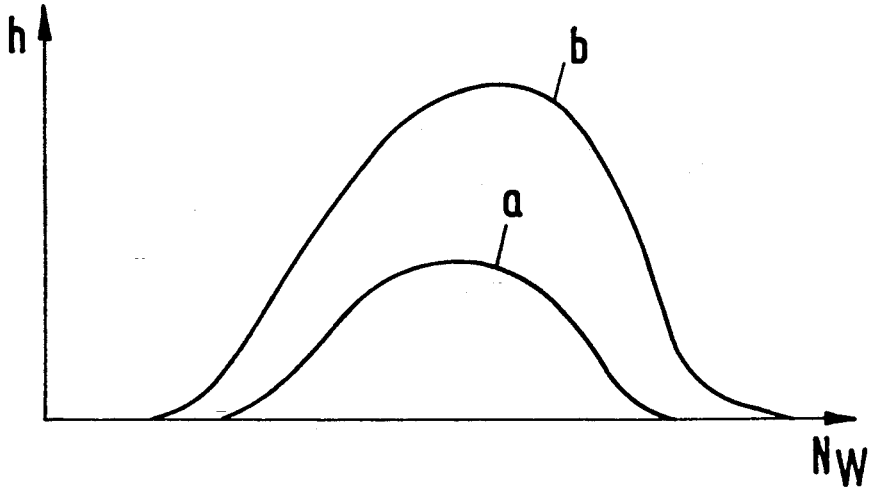
FIG. 2 is a graphical representation showing the valve lift plotted against cam angle for the embodiment shown in FIG. 1.

In all positions of the cup plunger 13, the pressure chamber 15 is in flow communication with a pressure line 21 containing a control valve 22. In the open position of the control valve 22 shown in FIG. 1, the line 21 connects the pressure chamber 15 to a volume-compensating cylinder 23 containing a spring-loaded piston 24. In addition, the line 21 leads to a lower-pressure hydraulic system 25, for example, an oil circuit for the engine. As a result, when the lift of the additional cams 3 and 4 becomes operative, the pressure chamber 15 is decreased in length in the direction of the centerline 9, since the plunger 8 rests on the lift valve stem 9. Accordingly, in this condition the lift curve of the valve 9 follows that of the cam 2, as shown at "a" in FIG. 2.

If the control valve 22 is turned 90 degrees into its closed position, the volume of the pressure chamber 15 is sealed from the compensating cylinder and the low-pressure system. Consequently, the cup plunger 13 moves the plunger 8 and hence the lift valve with it in accordance with the lift curve of the additional cams 3 and 4 so that the valve lift curve indicated at "b" in FIG. 2, corresponding to the lift curve of the additional cams 3 and 4, is applicable to the valve 9. Since this lift curve is higher than the curve of the cam 2, the plunger 8 is lifted away from that cam.

In order to permit valve clearance compensation for both the pressure chamber 11 and, with the cooperation of the spring 19, the pressure chamber 15 in the cup plunger 13, even when the control valve 22 is in the closed position, a leak-compensating line 27 having a check valve 26 is provided. This line also permits replacement of any pressure medium which may escape through a vent 18 in the plunger 8.

It will be understood that care must be taken to assure that the two valve-clearance compensating devices described above can function properly by suitable matching of the force applied by a compression spring 28, which extends between the plunger 8 and the piston 10, the area of the inner head surface of the piston 10, the area of the shoulder surface 17, and the force applied by the spring 19.

Figure 3:
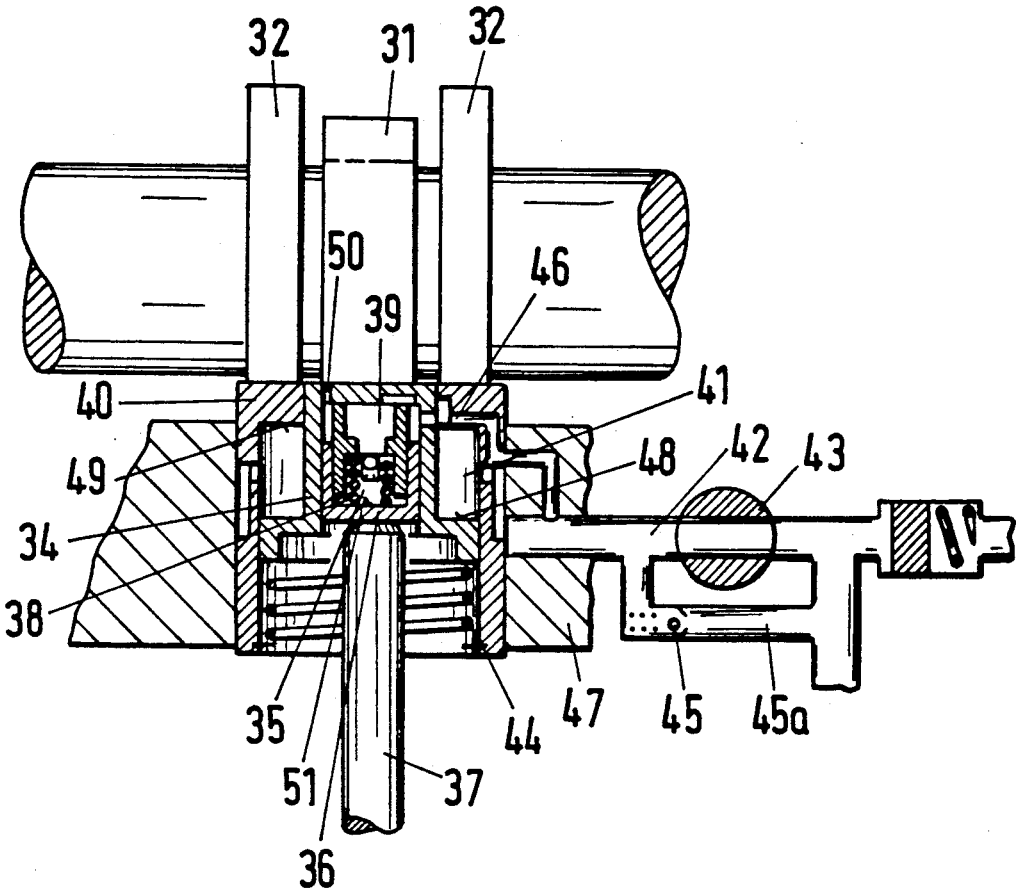
FIG. 3 is a fragmentary sectional view, similar to that of FIG. 1, illustrating another representative embodiment of the invention.

In a further typical embodiment shown in FIG. 3, a central cam 31 is mounted on a camshaft 30, and additional cams 32 and 33 are mounted on opposite sides of the central cam. The cam 31 engages a central plunger 34 which supports a lift valve stem 37 against the action of its closing spring (not shown) by way of a pressure chamber 35 and a piston 36 which engages the valve stem 37. As in the previously described embodiment, a compression spring 38 is provided in the pressure chamber 35, and above it a valve-clearance compensating arrangement 39 is provided for the plunger 34. An additional pressure chamber 41, enclosed by a cup plunger 40, surrounds the plunger 34 and in this case there is no compression spring in the additional pressure chamber. Instead, as shown in FIG. 3, a compression spring 44 acting between the two plungers 34 and 40 is mounted beneath the pressure chamber 41. With this arrangement, pressure relief is provided for the additional cams 32 and 33, particularly during their minimum lift phase.

In this embodiment of the invention, the pressure chamber 41 communicates in all conditions through suitably dimensioned passages with a pressure line 42 having a control valve 43. In addition, a leakage-compensating line 45*a* containing a check valve 45 bypasses the control valve 43. In contrast to the embodiment described with reference to FIG. 1, communication of the pressure chamber 35 with the passage 42 is not through the pressure chamber 41, but instead is through a separate passage 46 extending through the walls of the plungers 34 and 40 and the cylinder head 47 directly to the line 42. This design therefore permits extension of the spring 44 without interfering with the operation of valve-clearance compensation arrangement so that, with the control valve 43 open, in other words, in the "pressureless" condition of the pressure chamber 41, the facing surfaces 48 and 49 of the two plungers 34 and 40 are in contact. The cup plunger 40 is then moved in accordance with the control cam 31, being temporarily lifted by the plunger 34 away from the additional cams 32 and 33. An advantage of this mode of operation is that pumping of liquid into and out of the pressure chamber 41 is avoided.

Figure 4:
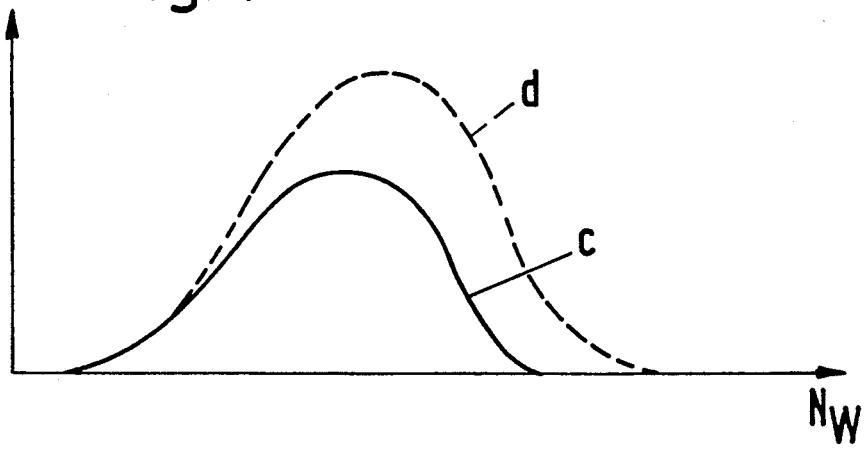
FIG. 4 is a graphical representation, similar to that of FIG. 2, for the embodiment of FIG. 3.

For noiseless re-engagement of the cup plunger 40 with the cams 32 and 33, the displacement of the lift curves of cam 31 on the one hand and of cams 32 and 33 on the other hand may be appropriately shaped, as shown in FIG. 4. In this illustration, the shape of the lift curve of cam 31 is indicated at "c", and the shape of the lift curves of the additional cams 32 and 33, which are retarded in relation thereto, is shown at "d".

The shoulder 48 of the plunger 34 is made small enough so that the hydraulic force acting upon it in the minimum lift phase of the cams will be less than the force of the compression spring 38 in the compensating arrangement 39. A pressure relief hole or vent 50 is provided in the plunger 34 and, if this vent is eliminated, the shoulder surface 48 on the one hand and the cross-sectional area of the piston 36, in other words, the inner head area 51 plus the marginal area, on the other hand, should be made approximately equal.

Figure 5:
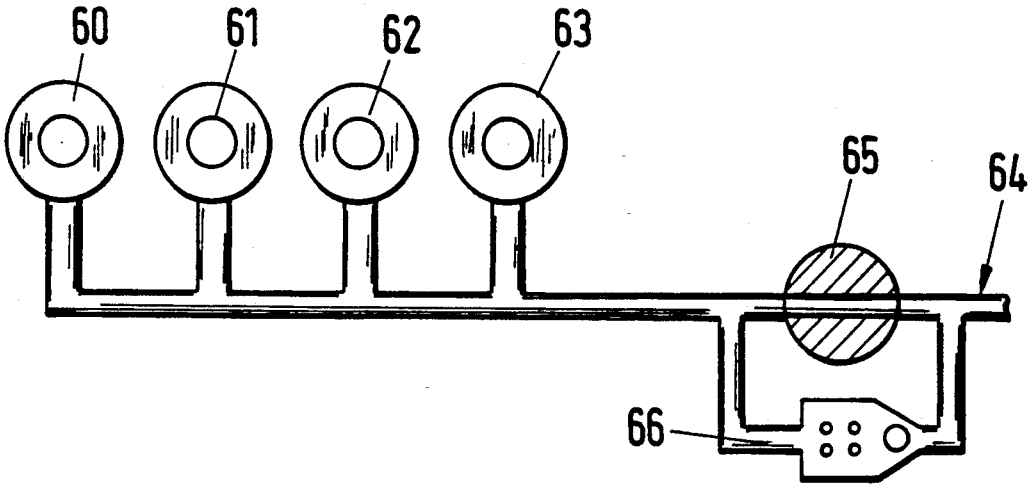
FIG. 5 is a schematic diagram showing one embodiment of an application of the invention to a multi-cylinder engine.

In the embodiment shown in FIG. 5, several force-transmitting arrangements 60, 61, 62 and 63 according to the invention, alternatively called two-plunger arrangements, are associated with a common pressure-setting system 64 having a control valve 65 and a leakage-compensating line 66. Such an economical arrangement is beneficial, for example, when several or all of the intake or exhaust valves of an internal combustion engine are to be actuated in the same manner.

In the manifold use of a single pressure-setting system to control several lift valves as represented in FIG. 5, problems may arise because, with the control valve 65 closed, pressure surges may be propagated from the lift valves into the pressure chamber 15 (shown in FIG. 1) of the hydraulic force-transmitting arrangement 7 for the other lift valves. This may be overcome by a modification of the arrangement in FIG. 1 which is illustrated in FIG. 6, in which the same parts are designated by the same reference numerals.

Figure 6:
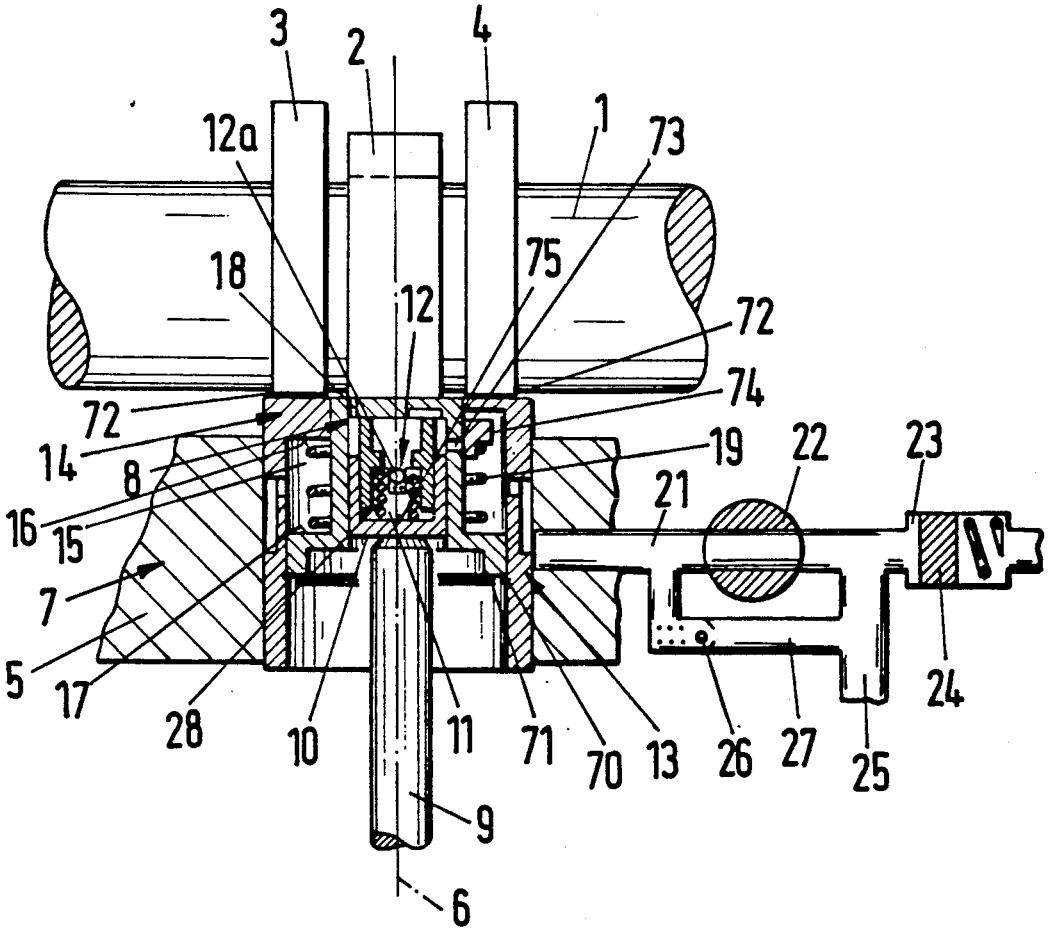
FIG. 6 is a fragmentary sectional view illustrating a modification of the embodiment shown in FIG. 1.

As shown in FIG. 6, two stops 70 and 71 have been added on the cup plunger 13 and the plunger 8, respectively. These stops are arranged so that they are operative during the minimum lift phases of the cams 2, 3 and 4, and will then provide support for the cup plunger 13 on the plunger B under the action of the spring 19 so that a slight clearance 72 is maintained between the head 14 of the cup plunger and the adjacent peripheral regions of the additional cams 3 and 4. Dampers between the stops to reduce impact noise and/or valve-clearance adjusting or compensating elements may be provided.

Another departure of the embodiment of FIG. 6 from the arrangement shown in FIG. 1 is that the throttle 20 of FIG. 1 is replaced by a liquid aperture 73 which temporarily communicates with the pressure chamber 15 through a passage 74 during the stroke of the cup plunger 13. Thus, the consumption of pressure medium which results from the drain through the throttle 20 and the vent 18 in the embodiment of FIG. 1 is reduced.

In the embodiment of FIG. 6, the vent 18 may also be eliminated. If the two apertures 73 and 74 are aligned during the lift action, the high pressure in the chamber 15 will be applied in the space enclosed by the plunger 8 and the piston 10. To prevent the piston 10 from moving the lift valve 9 in an undesired manner, the cross-sectional area of the piston which is subjected to pressure, i.e., the head area 75 plus the marginal area, is made smaller than the area of the shoulder 17 defining the pressure chamber 15.

The invention thus provides a variable valve action which will permit controlled operation of an engine by a main valve cam even if the pressure medium is low by sealing off a pressure chamber, except for replenishment of loss by leakage and for valve-clearance compensating purposes, and furthermore permits a large degree of freedom in achieving desired valve lift curves. At the same time, by intermediate settings of a control valve, it is also possible to achieve valve lift curves intermediate between two extremes.

Although the invention has been described herein with reference to specific embodiments, many modifications and variations therein will readily occur to those skilled in the art. Accordingly, all such variations and modifications are included within the intended scope of the invention.

I claim:

1. A variable valve action for a lift valve which is movable periodically between a closed position and an open position comprising main cam means and hydraulic force-transmitting means arranged between the main cam means and the lift valve, the hydraulic force-transmitting means including a first plunger responsive to the main cam means and a piston arranged to transmit force to the lift valve with the first plunger and the piston forming a first pressure chamber between them, hydraulic pressure control means including a control valve to control the pressure in the first pressure chamber and thereby adjust the axial length of the force-transmitting means in the direction of force transmission, a cup plunger surrounding the first plunger and displaceable with respect to the first plunger and forming a second pressure chamber extending annularly about the first plunger, the second pressure chamber being bounded in the axial direction by a shoulder formed in the first plunger and by a bottom end of the cup plunger, and further cam means including at least one additional cam synchronized with the main cam for applying force to the end of the cup plunger.

2. A valve action according to claim 1 wherein the further cam means includes two additional cams having identical lift curves and disposed on opposite sides of the main cam.

3. A valve action according to claim 1 wherein the additional cam has a lift curve providing a greater lift of the lift valve than the main cam.

4. A valve action according to claim 1 wherein the control valve is adjustable between a first position in which it seals off the second pressure chamber and a second position in which it connects the second pressure chamber to a low-pressure hydraulic system.

5. A valve action according to claim 1 including a compression spring arranged in the second pressure chamber and a check valve in a leakage-compensating line bypassing the control valve, said compression spring and said check valve together with the second pressure chamber constituting a valve-clearance equalizing means for the cup plunger and the second pressure chamber.

6. A valve action according to claim 5 including a check valve in the first pressure chamber to provide valve-clearance compensating means for the first plunger and a compression spring extending between the piston and the first plunger and wherein the first pressure chamber communicates with the second pressure chamber.

7. A valve action according to claim 1 including outside of the second pressure chamber a compression spring acting between the first plunger and the cup plunger tending to reduce the axial length of the second pressure chamber.

8. A valve action according to claim 7 including a check valve in the first pressure chamber and a compression spring disposed between the piston and the first plunger to form a valve-clearance compensating means for the first plunger and including at least one passage in the cup plunger for communication with a leakage-compensating line.

9. A valve action according to claim 8 wherein the compression spring outside the second chamber is arranged so that, upon relief of pressure in the second pressure chamber, mutually facing surfaces of the bottom end of the cup plunger and the shoulder of the first plunger will be engaged.

10. A valve action according to claim 9 wherein the shoulder of the first plunger is so dimensioned that, when the communication passage in the cup plunger is open during the minimum lift phase of the additional cam, the forces acting on the first plunger in the direction of axial lengthening of the second pressure chamber are less than the force of the compression spring outside the second chamber.

11. A valve action according to claim 5 including passage means providing communication between the first and second pressure chambers during the lift phase of the cup plunger and wherein the area of the shoulder of the first plunger is greater than the internal area of the head of the piston.

12. A valve action according to claim 1 including stop means mounted on the cup plunger and on the first plunger which cooperate during the minimum lift phase of the additional cam to maintain a clearance between the cup plunger and the additional cam.

13. A valve action according to claim 1 including a plurality of lift valves and a corresponding plurality of hydraulic force-transmitting means and wherein the hydraulic pressure control means is arranged to control the pressure in all of the hydraulic force-transmitting means.

* * * * *